United States Patent [19]

Gucwa, Jr. et al.

[11] 4,306,421

[45] Dec. 22, 1981

[54] HEAT EXCHANGER CAPILLARY TUBE ROUTING

[75] Inventors: Eugene F. Gucwa, Jr., McMinnville; Jackie D. Francis, Woodbury, both of Tenn.

[73] Assignee: Carrier Corporation, Syracuse, N.Y.

[21] Appl. No.: 136,028

[22] Filed: Mar. 31, 1980

[51] Int. Cl.[3] ..... F25B 13/00; F25B 41/06

[52] U.S. Cl. ..... 62/324.1; 62/511

[58] Field of Search ..... 62/324 A, 324 R, 160, 62/504, 511

[56] References Cited

U.S. PATENT DOCUMENTS

| | | | |
|---|---|---|---|
| 2,267,152 | 12/1941 | Gygax | 62/511 X |
| 2,393,854 | 1/1946 | Carpenter | 62/511 |
| 2,402,802 | 6/1946 | Carter | 62/504 X |
| 2,807,940 | 10/1957 | Urban | 62/511 X |
| 4,057,976 | 11/1977 | del Toro et al. | 62/324 R |

*Primary Examiner*—Lloyd L. King

*Attorney, Agent, or Firm*—J. Raymond Curtin; Robert P. Hayter

[57] ABSTRACT

A heat exchanger assembly and subassembly having a combination of liquid line header and a series of spaced helically wound capillary tubes. The liquid line header is mounted such that capillary tubes may be connected therefrom to the appropriate feeder tubes or other connections of the heat exchanger. Capillary tubes are helically wound about the liquid line header such that a compact, neat capillary tube arrangement is provided with a short distance between the two ends of the capillary. A dummy header may be utilized such that the capillary tube extends through the dummy header to a feeder tube to feed the appropriate refrigerant circuit.

11 Claims, 5 Drawing Figures

HEAT EXCHANGER CAPILLARY TUBE ROUTING

BACKGROUND OF THE INVENTION

1. Field of the Invention

This invention in general relates to heat exchanger assemblies and more particularly to the routing of capillary tubes to feed refrigerant into the circuits of the heat exchanger.

2. Prior Art

A heat exchanger, as used in an air conditioning system or a refrigeration application, is designed to have refrigerant flowing through tubes and a heat transfer media to be heated or cooled flowing in heat exchange relation with those tubes. In all but the smallest heat exchangers it is common to have more than one fluid flow circuit through the heat exchanger. Hence, it is necessary to make connections to each of the circuits so that they may be arranged in the appropriate configuration.

In refrigeration circuits it is additionally necessary when the heat exchanger is serving as an evaporator that the refrigerant undergo a pressure drop just before entering the circuit such that liquid refrigerant may be evaporated to a gas to absorb heat energy from the media to be cooled. Numerous expansion devices are known in the art to accomplish this pressure drop including a capillary tube. Such a tube is a small internal diameter tube of a predetermined length to achieve the desired pressure drop.

Heretofore, in multiple circuit heat exchangers it has been customary to utilize a capillary tube for each circuit in the heat exchanger and to connect each capillary tube at one end to a distributor and at the other end to each circuit of the heat exchanger. When the circuits of the heat exchanger become numerous the capillary tubes are wound like spaghetti about an end of the heat exchanger, all the capillary tubes originating from one point and terminating at the various circuits. In even more complex applications more than one distributor may be used such that there is considerable intertwining of capillary tubes and the concurrent problems are multiplied. A typical example of a single distributor feeding a series of capillary tubes for a heat exchanger may be found in U.S. Pat. No. 4,057,975. Therein, in FIG. 2 there is disclosed a complex coil having seven circuits, each fed by a separate capillary tube.

It has been found that when numerous capillary tubes are bent around, through, between or among hairpins, return bend headers, feeder tubes and other complex connecting piping at the end of the heat exchanger that these tubes end up in various complex positions, sometimes under stress and in positions where there is potential for the capillary tubes to either rub against an adjacent tube or another capillary tube. During operation of a refrigeration machine the utilization of a compressor or fan or the vibrations involved in transportation may cause the capillary tubes and other piping to rub against each other. Capillary tubes, by their very nature, are small in diameter and have relatively thin walls. Physical contact of a capillary with another component may result in damage to the capillary's function especially if its internal diameter is decreased. Complete failure of the capillary with concommitant failure of the refrigeration circuit caused by leakage of refrigerant may result from a capillary tube rubbing another object.

The present capillary tube arrangement allows the individual capillaries to be mechanically formed into a predetermined configuration prior to being integrated into the heat exchanger. Previous arrangments required individual manual forming of each capillary tube which was both time consuming and fatiguing.

It has also been found in units with complex capillary tube circuiting that the service or repair person may not be able to ascertain which capillary tubes are working properly by detecting the individual temperature thereof. It is conventional to place a hand on a capillary tube to ascertain its temperature to determine whether or not it is blocked. When many capillary tubes are located in a close region, it is impossible or very difficult to ascertain the temperature of each individual tube since heat energy is transmitted between them.

The capillary tube arrangement as disclosed herein incorporates a liquid header with the capillary tubes formed in a tightly wound spiral or helical configuration about the header. The header is mounted parallel to the piping end of the coil such that a neat arrangement of capillary tubes may be formed about the liquid line header. The location of the header is such that the capillary tube merely connects openings spaced along the header to the appropriate circuits spaced along the heat exchanger. The relative position of the header to the circuits of the heat exchanger acts to reduce the overall distance between openings to be connected. Since the overall length of a capillary of a predetermined internal diameter is a function of the desired pressure drop the distance between the liquid header and the circuit to be connected thereto must be less than this length. The length of a capillary tube greater than the distance between the header and the circuit is formed by winding the capillary tube into a helical configuration about the liquid line header such that the design length of the capillary tube is maintained the same and the location of that tube is tightly configured in a known location out of the way of the piping. This compact, neat arrangement provides for the elimination of the potential of rubbing among the various other components as is found when all the capillary tubes originate in a single distributor. Additionally, by separating the capillary tubes along the liquid header, it is possible for the service person to individually detect the temperature of each since they are spaced far enough apart so that the temperature of each may reflect whether or not that capillary tube is functioning properly. Consequently, the service person can place his hand on the capillary tube to ascertain whether or not it is hot or cold depending upon the operation of the unit.

SUMMARY OF THE INVENTION

It is the object of the present invention to provide means for connecting capillary tubes between a liquid line of a refrigeration circuit and the circuits of the heat exchanger to which the refrigerant is to be conducted.

It is a further object of the present invention to provide a neat, orderly and compact capillary tube arrangement and to prevent the failure of the capillary tubes caused by mechanical rubbing with other tubes or other components of the heat exchanger.

It is a further object of the present invention to provide a liquid line header in combination with helically wound capillary tubes such that the individual temperature of the tubes may be detected by manual sensing.

It is a further object of the present invention to provide a safe, economical, reliable, easy to manufacture and neat appearing capillary tube liquid line header subassembly for use with a heat exchanger.

Other objects will be apparent from the description to follow and the appended claims.

These and other objects are achieved in accordance with the preferred embodiment of the present invention wherein there is provided a liquid line header mounted generally parallel to the gas header at the end of the heat exchanger having the various piping connections. Openings are spaced along the length of the liquid line header in conjunction with the various circuits in the coil such that the capillary tubes extend a relatively short distance from the liquid line header to the circuits to make the appropriate connections. The capillary tubes are wound in a cylindrical configuration about the liquid line header. The capillary tube is connected inwardly from the helical portion to the header and outwardly therefrom to the circuit of the heat exchanger. A dummy header may be used between the feeder tubes to the circuits of the heat exchanger and the capillary tube such that the capillary tube need only connect through the dummy header to the feeder tube and not extend to the individual circuits of the heat exchanger.

DESCRIPTION OF THE PREFERRED EMBODIMENT

The embodiment hereinafter described will refer to a sixteen circuit heat exchanger being capable of changing circuit arrangements depending upon the mode of operation of the heat exchanger. It is to be understood that this invention finds applicability to heat exchangers not having the capability to change circuiting therethrough dependent upon the mode of operation. It is further to be understood that this invention has applicability to heat exchangers not used with heat pumps. It is believed that this invention may be used with air conditioning as well as refrigeration applications.

Figure 1:
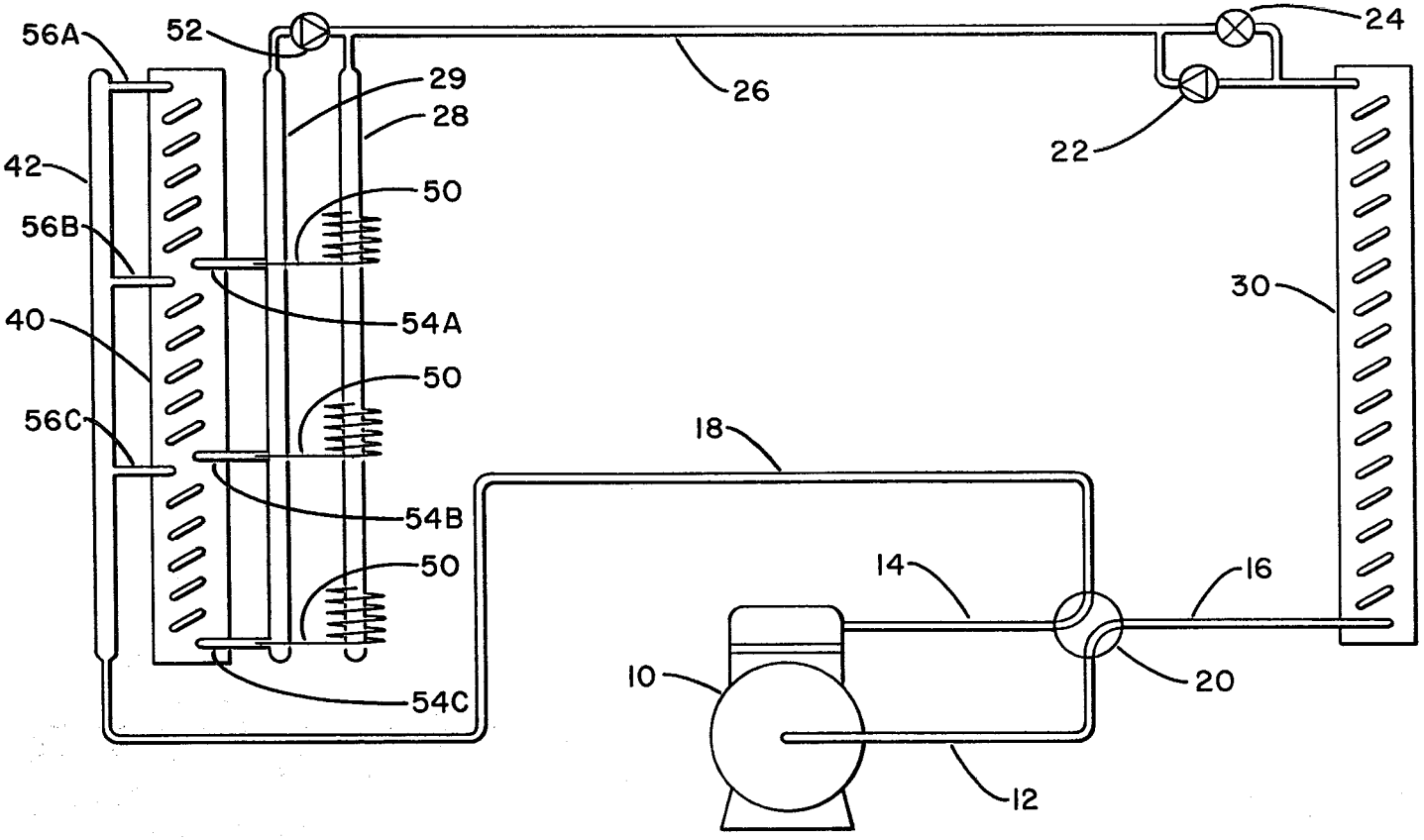
FIG. 1 is a schematic view of a heat pump system showing a liquid line header with capillary tubes wound helically thereabout.

Referring first to FIG. 1 there may be seen a schematic diagram of a heat pump system. Compressor 10 is connected to reversing valve 20 by discharge line 14 and suction line 12. Reversing valve 20 is connected to first heat exchanger 30 by line 16 and to gas header 42 of the second heat exchanger 40 by line 18. First heat exchanger 30 is connected to first header 28 of the second heat exchanger via line 26. Within line 26 is mounted check valve 22 and in parallel therewith expansion valve 24.

Second heat exchanger 40 has gas header 42 associated therewith and feeder tubes 56A through 56C connected between the heat exchanger core and gas header 42. As shown, the three circuit heat exchanger has a feeder tube connected one to each circuit. Second heat exchanger 40 additionally has feeder tubes 54A through 54C connected to the opposite side of the refrigeration circuits to second header 29. Second header 29 is connected through check valve 52 to line 26. First header 28 which is also connected to line 26 has capillary tubes 50 connected thereto and extending therefrom through second header 29 into feeder tubes 54A through 54C.

During operation of the system shown in FIG. 1 the compressor will discharge hot gaseous refrigerant to either heat exchanger depending upon the mode of operation. Assuming the first heat exchanger is an outdoor heat exchanger then in the cooling mode of operation reversing valve 20 will be positioned such that hot gaseous refrigerant is discharged to first heat exchanger 30 where it is condensed and then flows through line 26 through check valve 22 to first header 28. Check valve 52 prevents refrigerant from flowing from line 26 to second header 29. From first header 28 refrigerant flows through capillaries 50 through second header 29 into feeder tubes 54A, 54B and 54C. The refrigerant undergoes a pressure drop in the capillary tubes and is introduced into second heat exchanger 40 through the feeder tubes at a reduced pressure. The refrigerant then evaporated from a liquid to a gas in second heat exchanger 40 and passes through feeder tubes 56A through 56C to gas header 42 and back to the compressor to complete the cycle. The refrigerant flowing from first header 28 through the capillary tubes to feeder tubes 54A does not flow through second header 29 to line 26 since the high pressure in line 26 acts to prevent any flow through check valve 52.

In the heating mode of operation refrigerant will flow as shown in FIG. 1 from the compressor to gas header 42. In this mode of operation, gaseous refrigerant will flow through feeder tubes 56A through 56C to the three circuits of the heat exchanger and from there into feeder tubes 54A through 54C. This refrigerant will then flow into second header 29 through check valve 52 into line 26. A negligible amount of refrigerant may flow through the high resistance capillary tubes into line 26. Check valve 22 forces refrigerant flowing through line 26 to flow through expansion valve 24 wherein it undergoes a pressure drop before it is discharged into the first heat exchanger 30 serving as an evaporator. Liquid refrigerant evaporates in first heat exchanger 30 and is then conducted therefrom through line 16 and the reversing valve back to the compressor to complete the cycle.

FIGS. 2 through 5 show a complex heat exchanger adapted to vary circuiting depending upon the direction of refrigerant flow. These drawings show a heat exchanger which has the same functions as the heat exchanger shown in FIG. 1, however, this heat exchanger has a total of sixteen circuits and incorporates more complicated headering devices.

Figure 2:
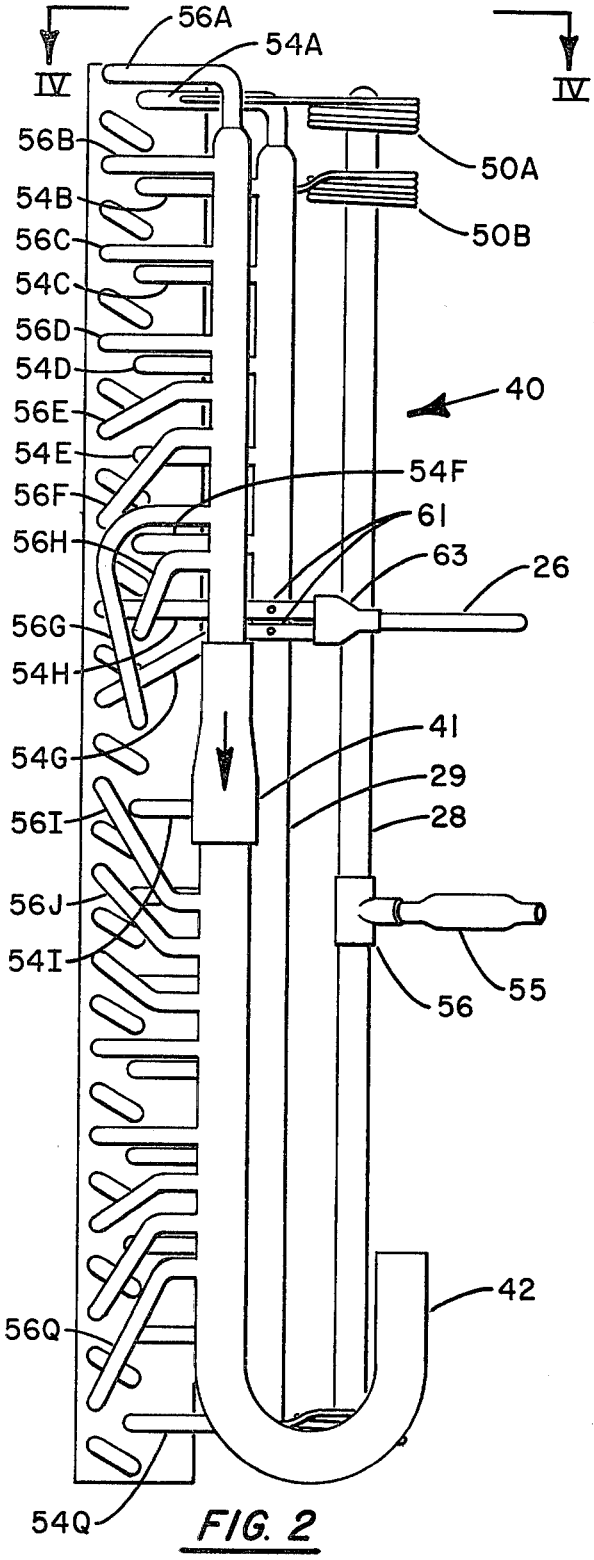
FIG. 2 is an end view of a plate fin heat exchanger showing various headers and some of the capillary tubes.

Referring first to FIG. 2 it can be seen that second heat exchanger 40 has gas header 42 which is divided into two portions by check valve 41. Gas header 42 is connected by feeder tubes 56A through 56Q, sixteen in all, one to each circuit of the heat exchanger. Mounted in parallel relation with gas header 42 is second header or dummy header 29. Dummy header 29 has feeder tubes 54A through 54F and 54I through 54Q (54J through 54R not shown) connected one to each of fourteen of the refrigerant circuits. The remaining two refrigerant circuits are connected by lines 61 through connector 63 to line 26. Lines 61 where they enter the heat exchanger are designated 54G and 54H.

Mounted parallel to both the dummy header and the gas header is liquid header 28. Liquid header 28 receives liquid refrigerant through strainer 55 connected thereto by tee 56. Sixteen capillary tubes 50A, 50B, etc. (not all are shown for clarity of the drawing) are located along the length of the liquid line header, one to be connected to each circuit. As shown in the drawing, capillary 50A is connected to the A circuit with the capillary tube joining the liquid line header to feeder tube 54A. Capillary tubes 50B through 50F and 50I through 50Q are all connected through the dummy header to the appropriate feeder tubes. Capillary tubes 50G and 50H are connected to lines 61 at a point as indicated such that the G and H circuits may be fed therethrough.

Figure 3:
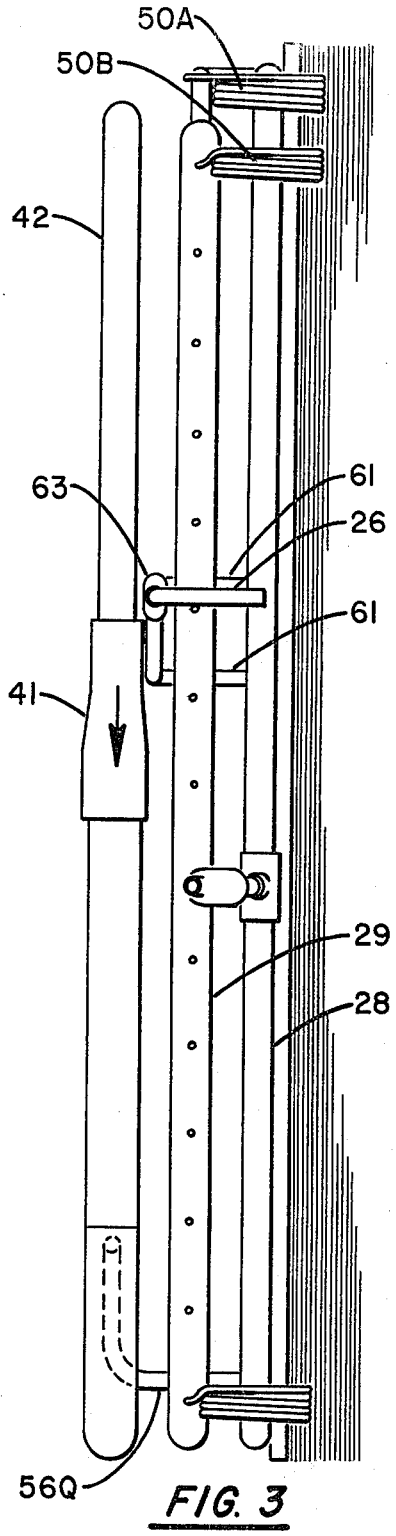
FIG. 3 is a side view of the same heat exchanger as shown in FIG. 2.

Referring now to FIG. 3 which is a view of FIG. 2 at right angles thereto the relative positions of gas header 42, dummy header 29 and liquid header 28 may be seen. Points are marked in liquid header 28 to indicate from where the capillary tubes are connected. Again, only capillaries 50A, 50B and 50Q are shown for the sake of clarity. The connection of line 26 to connector 63 and lines 61 leading to circuits G and H of the coil are also shown in FIG. 3.

Figure 4:
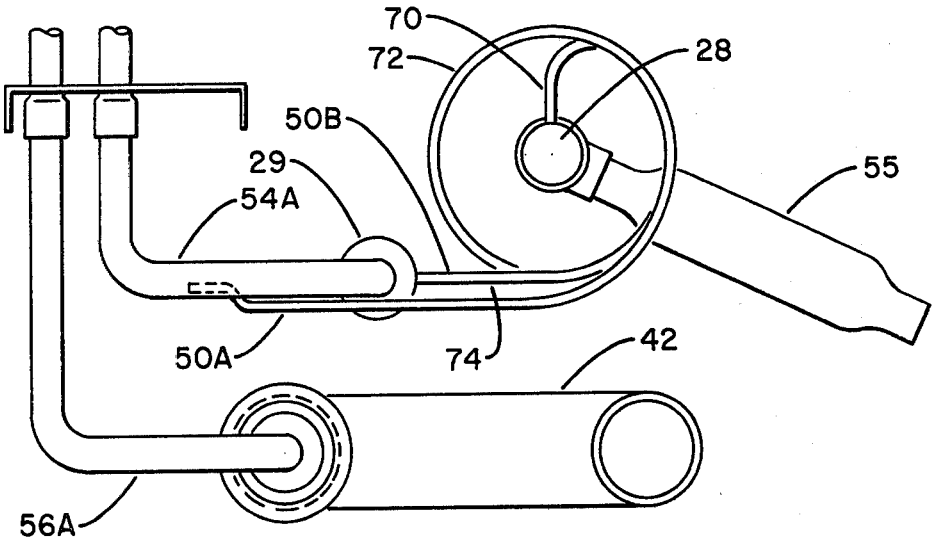
FIG. 4 is a view of the heat exchanger in FIG. 2 taken along line IV—IV.

FIG. 4 is a top view of FIG. 2 taken as shown at line IV—IV. Therein can be seen the top relationship between gas header 42, dummy header 29 and liquid line header 28. Strainer 55 is connected to liquid header 28 and helically wound capillary tubes 50A and 50B are connected to the liquid line header. The capillary tube referred to as 50B, designated as the second capillary tube shown in FIGS. 2 and 3, has three portions, a helical portion 72, an inward portion 70 extending from the helical portion inward to the liquid line header to which it is attached and an outward portion 74 extending from the helical portion outwardly to the dummy header 29 in this instance. Although not shown in FIG. 4 the capillary tube extends through the dummy header and discharges into feeder tube 54B to feed into the B circuit of the heat exchanger. The B circuit is connected likewise to gas header 42.

FIG. 4 also shows the connection of the capillary tube of the A circuit into the feeder tube 54A and similar connections are also made for the G and H circuits being connected to lines 61. It can be seen that the 50A capillary tube undergoes a minor bend as it travels into the feeder tube. The end of capillary tube 50A is then bent parallel to the feeder tube to discharge the refrigerant therefrom in the correct direction.

Figure 5:
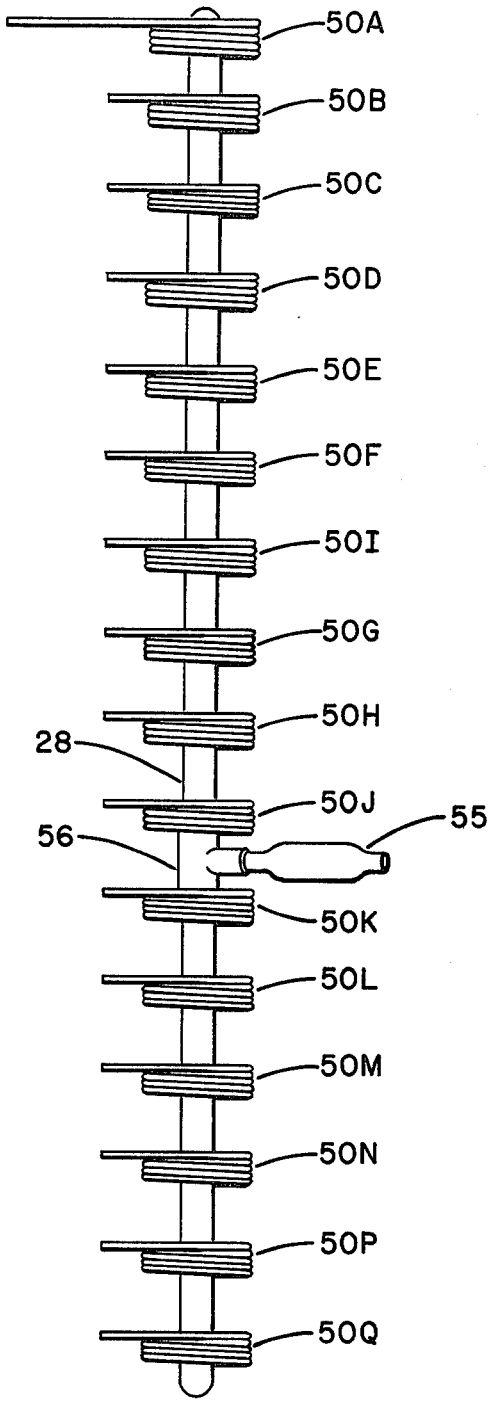
FIG. 5 is a side view of the liquid line header having sixteen capillary tubes connected thereto.

FIG. 5 discloses a view of a subassembly having liquid line header 28 and all sixteen capillary tubes 50A through 50Q helically wound thereabout and extending therefrom. Strainer 55 connected by tee 56 to the liquid line header is also shown.

If the heat exchanger shown in FIGS. 2 and 3 is serving as a condenser, hot gaseous refrigerant will enter through gas header 42 and flow therefrom through feeder tubes 56I through 56Q into the I through Q circuits of the heat exchanger. This gaseous refrigerant will therein be partially condensed and flow therefrom through feeder tubes 54I through 54Q to dummy header 29. This refrigerant will then flow along dummy header 29 and back into the heat exchanger through feeder tubes 54A through 54F. The refrigerant will be further condensed and/or subcooled as it flows through the A through F circuits and will then pass from these circuits through feeder tubes 56A through F into the top portion of gas header 42 as shown in FIG. 2. As the refrigerant reenters the top portion of gas header 42 through feeder tubes 56A through 56F it flows along the tube and is discharged therefrom through feeder tubes 56H and 56F. Refrigerant then flows through G and H circuits where it is further condensed and/or subcooled and is discharged therefrom through tubes 61 (also designated 54G and 54H) to line 26 wherein it is conducted to the other heat exchanger of the system for evaporating as earlier described in the system schematic.

When heat exchanger 40 is serving as an evaporator, refrigerant travels, as shown in FIG. 1, along line 26 where it is directed by check valve 52 into first header 28 or liquid header 28. There is no refrigerant flow from line 26 into dummy header 29. Refrigerant flows from liquid header 28 through all sixteen capillary tubes which discharge one into each of the sixteen circuits of the heat exchanger. The liquid refrigerant evaporates in the heat exchanger and is discharged as gas through feeder tubes 56A through 56Q into gas header 42 wherefrom it is conducted back to the compressor to complete the cycle. The liquid refrigerant travels through capillary tubes 50B through 50F and 50I through 50Q which tubes extend through the dummy header to the beginning of the corresponding feeder tube. Capillary tube 50A discharges directly into feeder tube 54A. Capillary tubes 50G and 50H discharge into tube 61 feeding the G and H circuits of the heat exchanger.

There has been disclosed a neat, orderly and safe assembly incorporating capillary tubes into a complex heat exchanger. The utilization of a liquid line parallel to a header serving the feeder tubes provide for the shortest possible connection therebetween. The helical winding of the capillary tubes about the header further provides a neat, compact package for maintaining the capillary tube in position. This combination results in an improved assembly which eliminates potential for capillary tube failure either due to blockage or rupture. This improved assembly additionally promotes additional servicability by separating the capillary tubes such that individual operation of each may be detected.

The invention has been described herein with reference to a particular embodiment. It is to be understood by those skilled in the art that various changes and modifications may be made and equivalents substituted for the elements thereof without departing from the scope of the invention.

We claim:

1. A heat exchanger assembly for use with a refrigeration circuit which comprises:

a heat exchanger core having a plurality of circuits through which refrigerant may flow;

a gas header connected to at least one of the circuits of the heat exchanger core for circulating gaseous refrigerant in conjunction therewith;

a liquid supply means for supplying liquid refrigerant, said liquid supply means having a plurality of openings spaced along at least a portion thereof; and a series of capillary tubes, each tube having a tightly wound helical portion attached at one end to an opening in the liquid header and connected to a circuit of the heat exchanger core, the helical portion being spaced from the helical portion of other capillaries as well as other components of the heat exchanger assembly and the liquid supply means being located within the center of the helical portion.

2. The apparatus as set forth in claim 1 wherein the liquid supply means is a liquid header, wherein the helical portion of the capillary tube is located with the liquid header inside a cylinder defined by the interior surfaces of the helical portion, wherein the end of the capillary tube to be joined to the liquid header extends inwardly from the helical portion to an opening formed in the liquid header and wherein the end of the capillary tube to be connected to a circuit of the heat exchanger core extends outwardly from the helical portion.

3. The apparatus as set forth in claim 2 wherein the circuits of the heat exchanger core are arranged within the heat exchanger core to terminate in spaced position along a plane of the heat exchanger core and wherein the liquid header is mounted as part of the heat exchange assembly in a plane parallel to the plane in which the circuits terminate and wherein the openings in the liquid header are spaced along the header in conjunction with the positions where the circuits of the heat exchanger terminate.

4. The apparatus as set forth in claim 2 and further including at least one feeder tube connected to a circuit of the heat exchanger core and wherein a capillary connected to the liquid header is joined to the feeder tube such that refrigerant supplied from the liquid header may flow through the capillary tube, and then through the feeder tube to a circuit of the heat exchanger core.

5. The apparatus as set forth in claim 2 and further including a dummy header and a series of feeder tubes, each feeder tube connecting the dummy header to one circuit in the heat exchanger core and wherein at least some of the capillary tubes are connected to extend into the dummy header to direct refrigerant from the capillary tubes into feeder tubes for selected circuits.

6. A heat exchange assembly including a heat exchange core for use with a reversible refrigeration circuit such that the heat exchange core of the assembly acts to transfer heat energy either as a condenser or as an evaporator which comprises:

a plurality of distinct refrigerant circuits forming the heat exchanger core;

a gas header connected to at least one of the circuits;

a dummy header;

feeder tubes for connecting the dummy header to at least one of the circuits of the heat exchange core, each feeder tube connecting the dummy header to a separate circuit;

a liquid supply means having at least one connection point for each circuit of the heat exchange core; and at least one capillary tube heaving a helically wound portion, said capillary tube connecting the liquid supply means to the feeder tube for a circuit by extending through the dummy header to direct refrigerant into a specific feeder tube for the corresponding circuit.

7. The apparatus as set forth in claim 6 wherein the liquid supply means is a liquid header and wherein the liquid header is located interior of the helically wound portion of the capillary tube.

8. The apparatus as set forth in claim 7 wherein the liquid header has a series of spaced openings, one opening for each circuit of the heat exchanger core and further having one capillary tube for each circuit of the heat exchanger, said capillary tubes being joined at one end to the respective openings in the liquid header and at least half of the capillary tubes being joined at the outer end to the feeder tubes for the respective circuits by extending through the dummy header to a position to supply refrigerant to the feeder tubes.

9. The apparatus as set forth in claim 7 wherein the capillary tubes are spaced from each other and do not contact any part of the heat exchanger assembly other than at the ends thereof.

10. The apparatus as set forth in claim 7 wherein the liquid header, the dummy header and the gas header are all mounted in a parallel side by side relationship.

11. A subassembly for supplying liquid refrigerant to a heat exchanger having a plurality of circuits which comprises:

a liquid header having a plurality of spaced openings along the length thereof;

means for connecting a supply of liquid refrigerant to the liquid header; and a series of capillary tubes, one joined to each spaced opening along the length of the liquid header, each capillary tube having a helical portion formed in a generally cylindrical configuration, an inward portion extending inwardly from the helical portion to the liquid header located inside the generally cylindrical helical portion and an outward portion extending outwardly from the helical portion whereby the outward portion may be connected to supply refrigerant received by the liquid header to a circuit of the heat exchanger.

* * * * *